United States Patent [19]

Rogoff

[11] 4,191,907

[45] Mar. 4, 1980

[54] COMPACT SINGLE-ENDED FLUORESCENT LAMP HAVING A PARTITIONED ENVELOPE

[75] Inventor: Gerald L. Rogoff, Wilkinsburg, Pa.

[73] Assignee: Westinghouse Electric Corp., Pittsburgh, Pa.

[21] Appl. No.: 944,495

[22] Filed: Sep. 21, 1978

[51] Int. Cl.[2] ..... H01J 17/04; H01J 63/04

[52] U.S. Cl. ..... 313/204; 313/485

[58] Field of Search ..... 313/204, 485

[56] References Cited

U.S. PATENT DOCUMENTS

| | | | |
|---|---|---|---|
| Re. 22,896 | 7/1947 | Polevitzky | 313/204 |
| 2,030,715 | 2/1936 | Pirani et al. | 313/204 |
| 2,121,333 | 6/1938 | Barclay | 313/205 |
| 3,024,383 | 3/1962 | Doering | 313/204 |
| 3,508,103 | 4/1970 | Young . | |
| 3,609,436 | 9/1971 | Campbell | 313/204 |

*Primary Examiner*—Robert Segal
*Attorney, Agent, or Firm*—D. S. Buleza

[57] ABSTRACT

A fluorescent light source of small physical size and high brightness is provided by making the vitreous envelope of cylindrical configuration and providing it with an inserted partition assembly that is coated with phosphor and longitudinally extends from the hermetically sealed end of the envelope to its flat end wall or face. The partition assembly preferably comprises a series of radiallyextending sheet metal panels that divide the envelope interior into a series of interconnected sectors that define a discharge channel which forces the discharge to follow a retroverted path through the envelope. One end of the partition assembly is seated against the flat end wall of the envelope and its opposite end is seated in keyed interlocked relationship with a disc-like support member that is held in place by the lead-in conductors and has channels which receive the ends of the partition panels. The discharge is prevented from bypassing the partition panels by soft gaskets of felt-like material that are sandwiched between the end edges of the partition panels and the abutting end wall of the envelope and disc-like support member, respectively. In an alternative embodiment, flanged partition panels and a non-channeled support member are used to prevent the discharge from bypassing the partition assembly. A fluorescent lamp having several independently-operable discharges rather than a single discharge is also provided by mounting the required number of paired electrodes at the sealed end of the envelope and employing a partition assembly that defines a corresponding number of separate discharge channels or paths.

10 Claims, 7 Drawing Figures

COMPACT SINGLE-ENDED FLUORESCENT LAMP HAVING A PARTITIONED ENVELOPE

CROSS-REFERENCE TO RELATED APPLICATIONS

The subject matter of this application is related in some respects to that disclosed and claimed in application Ser. No. 923,526, of R. G. Young, filed July 11, 1978, which application is assigned to the same assignee of this application.

BACKGROUND OF THE INVENTION

Field of the Invention

This invention relates to electric discharge lamps and has particular reference to an improved fluorescent lamp of compact size and high brightness that is suitable for use in residential and commercial lighting fixtures.

Description of the Prior Art

Electric discharge lamps having envelopes which are internally partitioned to provide one or more elongated discharge paths are generally well known in the art. U.S. Pat. No. 2,121,333 issued June 21, 1938 to Barclay discloses such a lamp of single-ended construction having glass panels that are joined to the glass envelope and serve as the partition means. Another type of single-ended fluorescent lamp is disclosed in U.S. Pat. No. 3,024,383 issued Mar. 6, 1962 to Doering wherein a thin sheet of glass or ceramic, or a stiffened sheet of fiberglass or the like, is used as the partition means. The partition is supported by the sealed end portion of the glass stem or by a disc-like base member that can be grooved to accept the partition and is seated on the stem. The partition assembly consists of a single panel or two panels that partly intersect and are perpendicular to one another. Short-circuiting of the discharge is prevented by thickening the edges and/or elastically seating the edges of a glass-textile or fiberglass partition against the envelope walls, or by providing the edges of a rigid partition with a compressible or elastic border or lining of fiberglass. The partition and inner surface of the envelope are coated with a fluorescent material. The fluorescent coating on the partition can, if desired, be replaced by a coating of ultraviolet reflective material such as magnesium oxide, silica powder, etc.

Fluorescent lamps having partitions that are fabricated from sheet metal which is coated with phosphor are also known in the art and are disclosed in U.S. Pat. Re. Nos. 22,896 (issued July 8, 1947 to Polevitzky) and 3,508,103 issued Apr. 21, 1970 to Young. A single-ended fluorescent lamp which contains a concentric cylindrical glass partition and several electrodes which are sequentially energized in such a manner that the discharge passes through the cylindrical partition and sweeps around the annular chamber defined by the partition and the envelope is disclosed in U.S. Pat. No. 3,609,436 issued Sept. 28, 1971 to Campbell. An electric discharge lamp of single-ended construction having an envelope that contains a box-like arc-enclosure consisting of joined metal baffles and light transmitting side panels that are secured to a stem component and define a tortuous path for the discharge is disclosed in U.S. Pat. No. 2,030,715 issued Feb. 11, 1936 to Pirani et al.

SUMMARY OF THE INVENTION

While the prior art partition lamps were satisfactory from a functional standpoint in that they provided fluorescent lamps of reduced size and enhanced brightness, they were difficult and expensive to manufacture on a mass-production basis and also had certain structural features which presented serious quality control problems. The use of a partition component that is joined to the walls of a glass envelope, for example, frequently introduced strains in the glass which caused the envelope to crack under certain conditions, even though a tedious glass-annealing operation is employed. In those prior art lamp designs where the partition component or assembly is not rigidly joined or attached to the envelope but merely inserted into place, the inherent tendency of the discharge to seek and pass through small gaps and crevices between the partition and walls of the envelope (or partition-support members) and thus bypass the partition also constituted a serious problem. The use of the tubular stem assemblies to support the partition assembly at the sealed end of the envelope further complicated lamp manufacture and resulted in a mount assembly that was rather fragile and easily damaged during shipment.

The foregoing deficiencies and difficulties with the prior art partition type discharge lamps are overcome in accordance with the present invention by employing an envelope of cylindrical configuration that has a substantially flat end wall and inserting a partition assembly into the envelope which is so constructed that it effects a tight fit with the flat end wall as well as the curved side walls of the envelope and produces a rugged but inexpensive single-ended lamp.

The partition assembly preferably consists of a series of panels of suitable material, such as sheet metal, that are joined together and divide the cylindrical envelope into a plurality of sectors which are interconnected and force the discharge to traverse the envelope in retroverted fashion. The partition assembly is held in abutting relationship with the flat end wall of the envelope by a planar support member that is seated against the opposite end of the partition assembly and is secured to the lead-in wires which are anchored in the sealed end of the envelope. The support member is provided with slots or channels which receive and interlock with the end edges of the partition panels. Gaskets of compliant felt-like material are sandwiched between the edges of the partition panels and the abutting envelope end wall and support member to close any gaps or openings that would permit the discharge to bypass the partition. Potential "discharge-leakage" paths along the longitudinal edges of the partition panels are eliminated by providing such edges with short flanges that overlap the envelope wall and thus serve as "barriers" which prevent the discharge from penetrating these junctures, in accordance with the teachings of the aforementioned pending application Ser. No. 923,526, of R. G. Young. Such flanges can also be used at the ends of the partition panels, if desired, in place of the aforesaid gaskets and channeled support member.

In an alternative embodiment, more than one discharge channel is provided by suitably modifying the partition assembly and sealing more than one pair of electrodes within the cylindrical envelope. By selectively energizing the paired electrodes, the lamp can be operated in either a single-discharge mode or multiple-discharge mode.

BRIEF DESCRIPTION OF THE DRAWINGS

A better understanding of the invention will be obtained from the following exemplary embodiments shown in the accompanying drawings, wherein.

DESCRIPTION OF THE PREFERRED EMBODIMENTS

Figure 1:
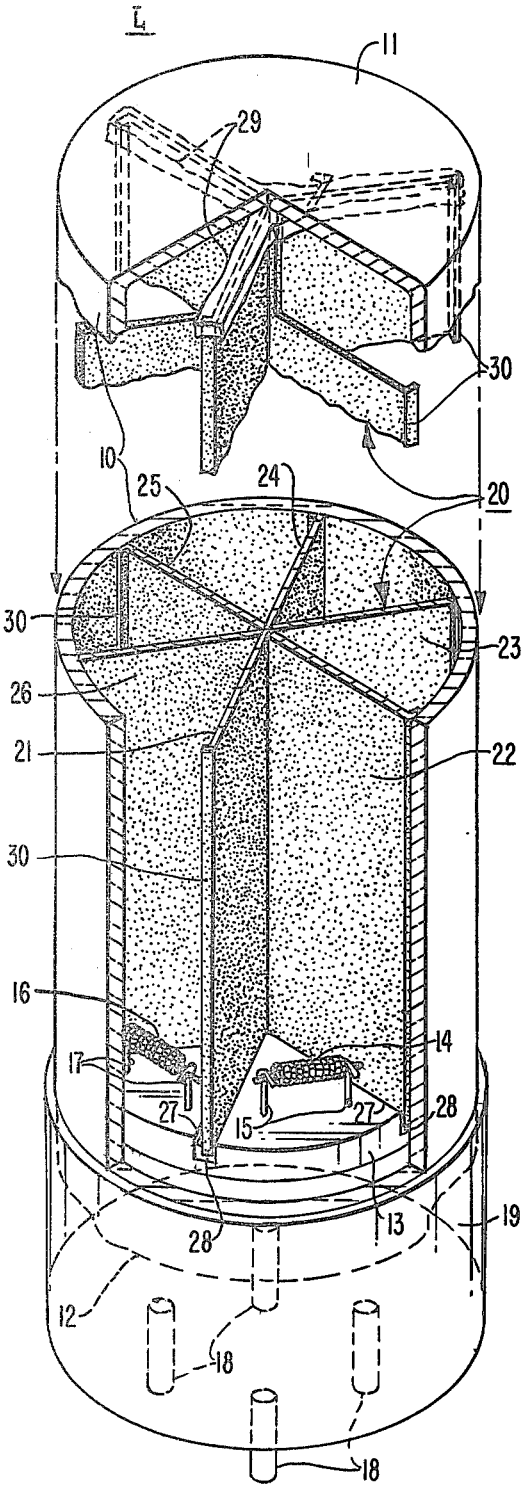
FIG. 1 is a perspective cutaway view of a compact single-ended fluorescent lamp that embodies the invention.

A compact fluorescent lamp L of single-ended construction that embodies the present invention is shown in FIG. 1. As will be noted, the lamp comprises a vitreous envelope 10 of cylindrical configuration that is terminated at one end by a flat end wall 11 and at its opposite end by a vitreous closure member such as a wafer-like stem 12 (shown in dotted outline) that is fused to and hermetically seals the envelope. A disc-like support member 13 of rigid insulating material is located at the sealed end of the envelope 10 and carries a pair of thermionic electrodes 14 and 16 that are attached to and supported by pairs of lead-in conductors 15 and 17 anchored in the support member, thus providing a pair of spaced electrode assemblies. The lead-in conductors extend through the support member 13 and the stem 12 and are connected to suitable terminals such as metal pins 18 which protrude from a base member 19 that is attached to the sealed end of the envelope. Before it is sealed, the envelope 10 is evacuated and then charged with a suitable fill gas (such as argon or a mixture of argon and neon at a pressure of several torr) and dosed with a measured quantity of mercury through a tubulation (not shown) in the usual manner to provide an ionizable medium that sustains an electric discharge when the lamp L is energized.

An elongated partition assembly 20 is mounted on the support member 13 and consists of six panels 21, 22, 23, 24, 25 and 26 that are joined together along a longitudinal axis that coincides with the axis of the cylindrical envelope 10. As shown more particularly in FIG. 2, the partition panels radially extend outwardly to the envelope walls and thus divide the interior of the envelope 10 into six sectors of approximately the same configuration and size. The electrodes 14 and 16 are physically isolated from each other by partition panel 21 which spans the entire distance between the support member 13 and the flat end wall 11 of the envelope 10. Partition panel 22 has an upper end segment removed (see FIG. 1) to provide an opening at the end wall 11 which provides a connecting passageway for the envelope sectors disposed on either side of panel 22. The remaining partition panels 23, 24, 25 and 26 have similar end segments removed at alternate ends of the envelope 10 to provide additional connecting passageways so that the partition assembly 20 defines a single continuous discharge channel that traverses the envelope 10 in retroverted fashion.

The discharge is prevented from bypassing the partition assembly 20 or any of its panel segments by providing a series of slot-like channels 27 in the inner face of the disc-like support member 13, which channels are aligned with and accommodate the end edges of the respective partition panels to effect a keyed-interlocking type juncture. Potential discharge-leakage paths through small cracks or openings between the end edges of the partition panels and support member 13 are eliminated by lining the channels 27 with layers or strips of compliant felt-like material that nestingly enclose the end edges of the panels and are joined together to form a gasket 28. A second gasket 29 of such material is sandwiched between the end edges of the partition assembly 20 and the flat end wall 11 of the envelope 10 at the opposite end of the lamp L.

Passage of the discharge through small openings along the longitudinal edges of the partition panels is prevented by providing such edges with short laterally-extending flanges 30 that are contiguous with and thus closely overlap the curved walls of the envelope 10--thereby increasing the "discharge-traverse" dimension of such gaps or crevices by an amount which prevents the discharge from entering and penetrating them, pursuant to the teachings of the aforementioned Young application Ser. No. 923,526. If desired, such flanges can also be provided along the end edges of partition panels and the gaskets 28, 29 omitted. The channels 27 in the partition-support member 13 can also be omitted and the flat inner surface of the support member fastened by cement (or other suitable means) to the associated flanged ends of the partition panels to provide junctures that are "leak-proof" with respect to the discharge.

While the partition panels 21, 22, 23, 24, 25 and 26 can be fabricated from any suitable sheet material, they are preferably fabricated from sheet metal (such as stainless steel or a nickel alloy) and are formed separately and then joined together by welding or other suitable means. The compliant gaskets 28 and 29 can also be made of any suitable inert material such as glass wool or quartz wool. Satisfactory results have been obtained by using gaskets made from soft fibrous material, such as a felt-like material that is composed of interlocked silica and alumina fibers and is marketed under the tradename "Fiberfrax" ceramic fiber by the Carborundum Company, Niagara Falls, N.Y.

The support member 13 can be made of any suitable inert electrically non-conductive material, for example a machinable glass material such as one which consists of a mixture of glass and mica. It can also be made of a conductive material, such as sheet metal, if insulating bushings or other means are used around the lead-in conductors to prevent short-circuiting them.

Figure 2:
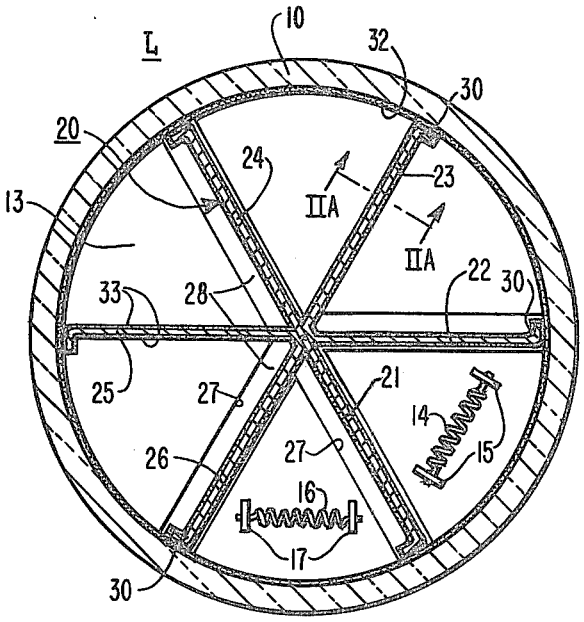
FIG. 2 is an enlarged cross-sectional view of the lamp shown in FIG. 1.
Figure 2A:
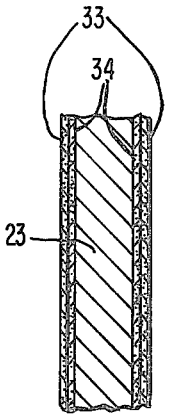
FIG. 2A is an enlarged cross-sectional view through one of the coated partition panels, along line IIA—IIA of FIG. 2.

As shown in FIG. 2, the inner surfaces of the envelope 10 are coated with a layer 32 of a suitable ultraviolet-responsive phosphor. The exposed surfaces of each of the partition panels 21–26 are similarly coated with a phosphor layer 33 in order to enhance the light output of the fluorescent lamp L. In the case of partition assemblies which are fabricated from sheet metal, optimum results have been achieved by first coating the metal surfaces with a layer 34 of suitable inert light-reflective material and then overcoating this layer with the phosphor layer 33 (as shown in FIG. 2A). Suitable light-reflecting materials for such base coats are $TiO_2$, MgO, $BaSO_4$, $Al_2O_3$, ZnO and mixtures thereof.

While various kinds of ultraviolet-responsive phosphor materials can be used in the aforesaid coatings, in lighting applications where good visual clarity and color rendition of the illuminated objects or scene are required, phosphor coatings which contain a blend of three phosphors that emit visible radiations in three different selected portions of the spectrum are desirably employed to provide a so-called "prime color" fluorescent lamp, pursuant to the teachings of W. A. Thornton in the article entitled "Luminosity And Color-Rendering Capability Of White Light", Journal of the Optical Society of America, Volume 61, No. 9, September 1971, page 1155. As a specific example, a suitable phosphor blend for a fluorescent lamp of this type contains manganese-activated zinc silicate, europium-activated strontium chlorophosphate, and europium-activated yttrium oxide phosphors.

Figure 3:
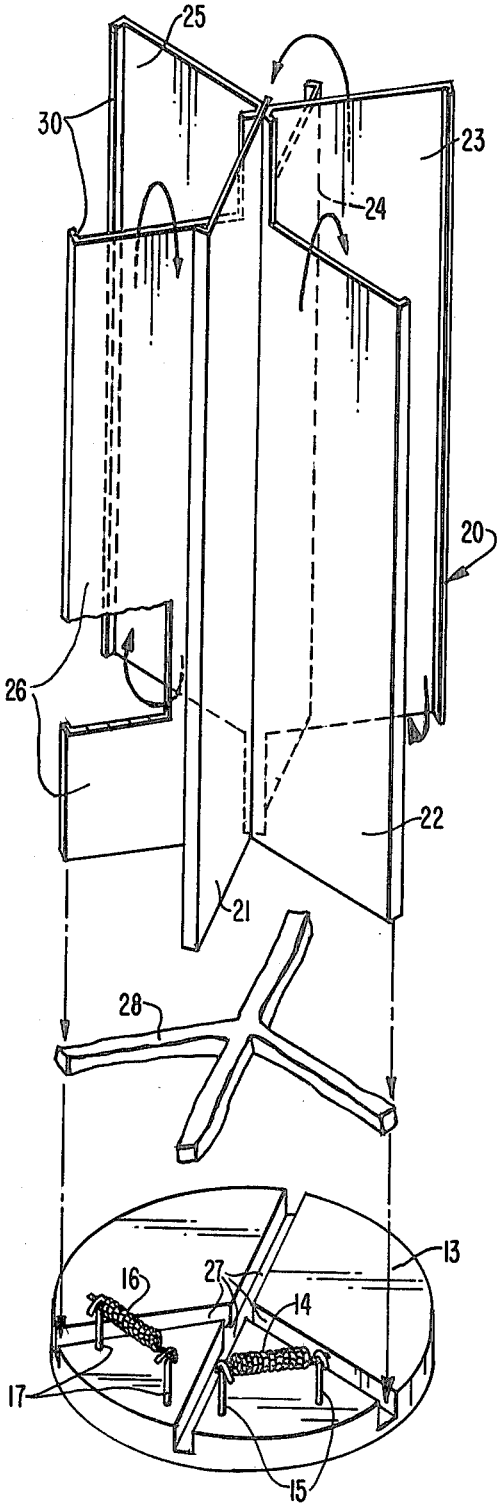
FIG. 3 is an exploded perspective view of the partition assembly, gasket component and partition-support member employed in the lamp shown in FIGS. 1 and 2.

As shown in FIG. 3, assembly of the partition component 20 with the gasket 28 and disc-like support member 13 is readily accomplished by first joining the lead wires 15 and 17 to the support member, mounting the electrodes 14 and 16 on the wires, inserting the gasket 28 into the matching channels 27 in the support member, and then inserting the end edges of the respective partition panels 21–26 into the mating channels in nested relationship with the soft gasket. As will be noted, connecting passageways at alternate ends of the partition assembly 20 are provided by removing the top portion of panel 22, the bottom portion of panel 23, the top portion of panel 24, the bottom portion of panel 25, and the top portion of panel 26. Panel 21 is not shortened or altered and accordingly isolates the electrodes 14 and 16 from each other. The discharge thus passes from electrode 14 along panels 21–22 and over the top of panel 22, and then along and around the other panels of the partition assembly 20 in retroverted fashion by passing through the openings at alternate ends of the consecutive panels (as indicated by the arrows in FIG. 3), and finally terminates at the other electrode 16. A square-shaped portion has been removed from the lower end of panel 26 in FIG. 3 for illustrative purposes only to show a full view of the end of panel 25.

MULTI-DISCHARGE LAMP EMBODIMENT (FIGS. 4–6)

The invention is not limited to single-ended fluorescent lamps that have envelopes, electrodes and partitions designed to provide a single continuous discharge channel but can be employed with equal advantage in single-ended fluorescent lamps having partition assemblies and paired electrodes that provide several independently-operable discharges. Such a lamp $L_a$ is shown in FIGS. 4–6 and will now be described.

Figure 4:
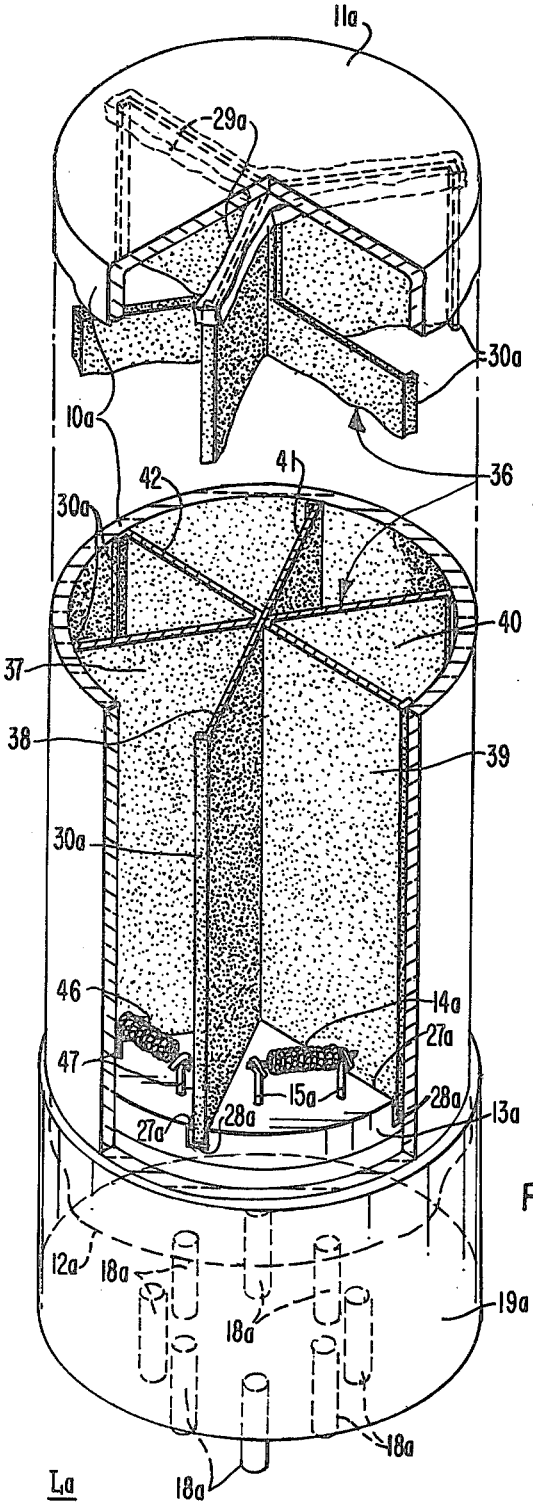
FIG. 4 is a perspective cutaway view of an alternative fluorescent lamp embodiment having a partition assembly and two pairs of electrodes that provide two independently-operable discharges.
Figure 5:
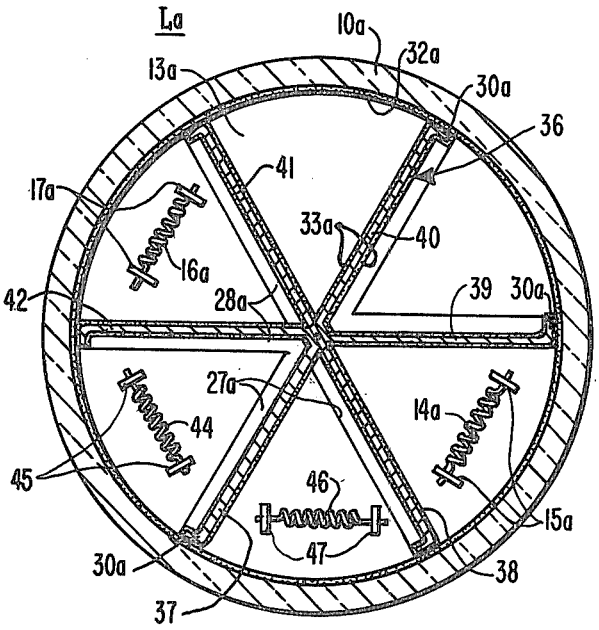
FIG. 5 is an enlarged cross-sectional view through the dual-discharge lamp shown in FIG. 4.

As illustrated in FIGS. 4 and 5, the interior of the cylindrical glass envelope **10*a* is again divided into six sectors by an inserted partition assembly 36 that includes conjoined radially-extending panels 37, 38, 39, 40, 41 and 42. The partition assembly 36 is held in seated relationship with the flat end 11*a* of the envelope by a channeled disc-like support member 13*a* which is attached to four pairs of lead-in wires 15*a*, 17*a*, 45 and 47 that are sealed through the glass closure member 12*a* and exteriorly connected to pin terminals 18*a* carried by a base member 19*a*. The longitudinal edges of the respective partition panels are provided with short flanges 30*a* and soft gaskets 28*a* and 29*a* are sandwiched between the ends of the partition panels and the envelope end wall 11*a* and slotted portions of the support member 13*a* to prevent the discharge from bypassing the partition assembly, as previously described. The inner surfaces of the envelope 10*a* and the surfaces of the partition panels are also covered with phosphor coatings 32*a* and 33*a***, respectively.

In contrast to the dual-electrode lamp embodiment of FIGS. 1–3, fluorescent lamp $L_a$ contains four electrodes **14*a*, 16*a*, 44 and 46 (see FIGS. 5 and 6) that are arranged in paired relationship and fastened to the four pairs of lead-in conductors 15*a*, 17*a*, 45 and 47 which are connected to a set of eight terminal pins 18*a*, thus permitting the paired electrodes to be selectively energized. As will be noted in FIG. 4, and more particularly in FIGS. 5 and 6, the first pair of electrodes 14*a* and 16*a* are physically isolated from the other pair of electrodes 44 and 46 by partition panels 38 and 42 which extend along the entire length of the envelope 10*a* from the disc-like support member 13*a* to the flat end wall 11*a* of the envelope 10*a*. However, the remaining panels 37, 39, 40 and 41 are each shortened in a manner such that they provide openings and interconnecting passageways at alternate ends of the partition assembly 36**, thus dividing the envelope interior into two separate discharge channels of retroverted configuration.

Figure 6:
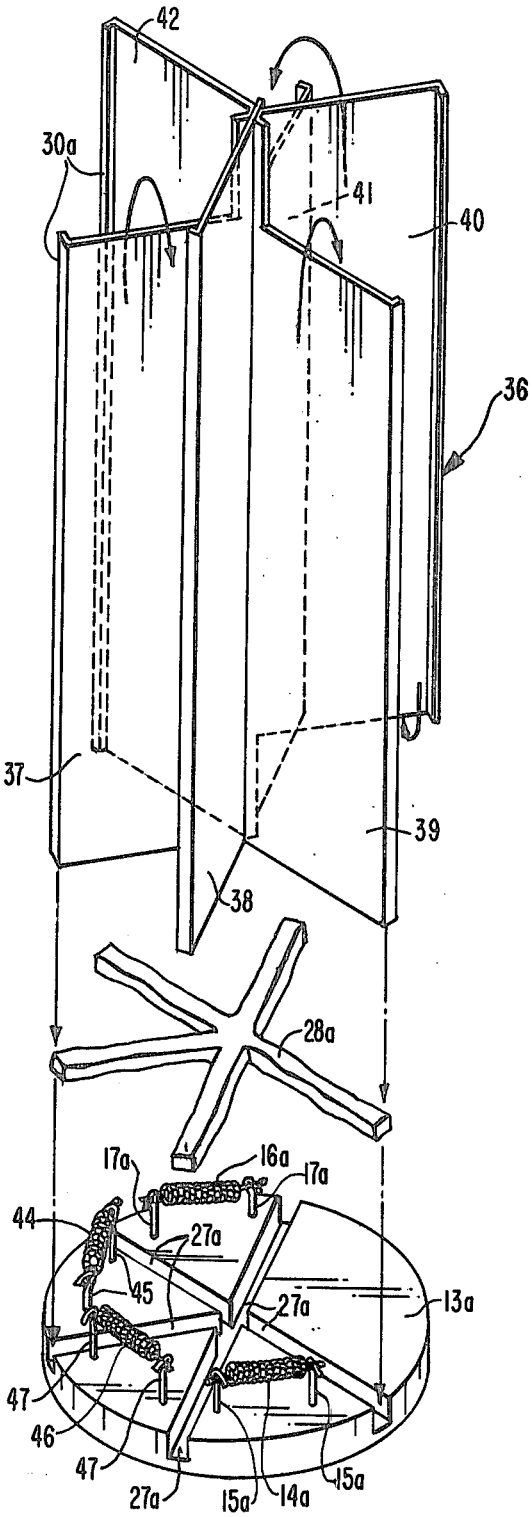
FIG. 6 is a perspective exploded view of the partition assembly, gasket component, and partition-support member used in the lamp embodiment illustrated in FIGS. 4–5.

As indicated by the arrows in FIG. 6, the first discharge channel permits the discharge to pass between electrodes **14*a* and 16*a* around the clipped ends of panels 39, 40 and 41. The second discharge channel permits another discharge to pass between electrodes 44 and 46 around the clipped end of panel 37. Thus, two separate and independently-operable electric discharges can be produced within the tubular envelope 10*a* simply by connecting the proper sets of pin terminals 18*a*** to a power supply. The fluorescent lamp $L_a$ can accordingly be operated in either a single-discharge mode or a dual-discharge mode, as desired. Of course, lamps having additional independently-operable discharges can be also made by sealing the required number of paired electrodes within the envelope and modifying the partition assembly to provide the additional retroverted discharge paths.

I claim as my invention:

1. A low-pressure electric discharge lamp of the single-ended type that is adapted for use as a compact high-intensity light source, said lamp comprising:
   - a light-transmitting vitreous envelope of tubular configuration that has a substantially flat end wall and is terminated by a closure member which is hermetically sealed to said envelope,
   - lead-in conductors extending through said closure member in paired relationship,
   - an electrode connected to and supported by each pair of lead-in conductors and thereby providing a plurality of spaced electrode assemblies at the sealed end of the envelope,
   - an ionizable medium within said envelope adapted to sustain an electric discharge when the electrodes are energized,
   - an elongated partition assembly within said envelope extending from the substantially flat end wall thereof toward and beyond the electrodes at the sealed end of the envelope, said partition assembly comprising a plurality of planar segments that are seated against the envelope end wall and radially extend from a longitudinal axis to the arcuate walls of said envelope and thereby divide the envelope interior into a plurality of sectors which define a tortuous discharge channel that traverses the envelope in retroverted fashion, and means holding the partition assembly in said position within the envelope comprising a support member of rigid material that extends transversely across the envelope interior and has a series of slot-like channels in its inwardly disposed face which are aligned with and accommodate the end edges of the planar segments of the partition assembly, each of said slot-like channels containing a layer of compliant material that is in nested relationship with the end edge of the associated planar segment and thereby provides a juncture which cannot be penetrated by the discharge and thus prevents the discharge from bypassing any of the planar segments, said lead-in conductors extending through said partition-support member and being so arranged that adjacent electrodes are physically isolated from one another by one of the planar segments of the partition assembly which completely spans the space between the partition-support member and the substantially flat end wall of the envelope.

2. The single-ended electric discharge lamp of claim 1 wherein:

said closure member is composed of vitreous material and is fused to the end of said envelope, said partition-support member is of disc-like configuration, composed of insulating material and joined to and held in place by the lead-in conductors, said ionizable medium comprises a fill gas and a predetermined amount of mercury, and the planar segments of the partition assembly and the inner surface of said tubular envelope are coated with phosphor and said discharge lamp thereby comprises a fluorescent lamp.

3. The single-ended fluorescent lamp of claim 2 wherein the envelope sectors which define the tortuous discharge channel are interconnected by passageways that are defined by openings in the associated planar segments of the partition assembly, said openings being alternately located at opposite ends of the envelope.

4. The single-ended fluorescent lamp of claim 3 wherein:

the layers of compliant material comprise strips that are joined to one another and thus constitute parts of a gasket component, and a second gasket component of compliant material is sandwiched between the substantially flat end wall of the envelope and the associated end edges of the partition assembly and thereby provides an envelope-partition juncture at that end of the lamp which is also devoid of discharge-leakage paths that would permit the discharge to bypass the partition assembly.

5. The single-ended fluorescent lamp of claim 3 wherein:

said gasket components are located at the bottom of the respective slot-like channels and are composed of fibrous felt-like material, the planar segments of said partition assembly comprise panels of sheet metal that are joined to one another along said longitudinal axis, and said sheet metal panels are so shaped and dimensioned that the ends of selected consecutive panels are alternately spaced from the substantially flat end wall of the envelope and the disc-like support member and thus provide said interconnecting passageways between adjacent envelope sectors.

6. The single-ended fluorescent lamp of claim 5 wherein:

a single pair of electrode assemblies are disposed at the sealed end of said envelope, the sheet metal partition panel that is located between said electrode assemblies extends from the disc-like support member to the substantially flat end wall of the envelope and thus physically isolates the electrodes from one another, and the remaining sheet metal partition panels have their end edges alternately spaced inwardly from the substantially flat end wall of the envelope and the disc-like support member so that the partition assembly provides a single continuous discharge channel of retroverted configuration.

7. The single-ended fluorescent lamp of claim 6 wherein:

said tubular envelope is of substantially cylindrical configuration, and the longitudinal axes of said partition assembly and envelope are substantially coincident with one another.

8. The single-ended fluorescent lamp of claim 5, wherein:

two pairs of electrode assemblies are disposed at the sealed end of said envelope, and said sheet metal partition panels are so shaped and arranged that they physically isolate one pair of electrodes from the other pair of electrodes and also define two separate retroverted discharge channels which permit the lamp to be operated in either a single-discharge mode or a dual-discharge mode.

9. The single-ended dual-channel fluorescent lamp of claim 8 wherein:

said tubular envelope is of substantially cylindrical configuration, and the longitudinal axes of said partition assembly and envelope are substantially coincident with one another.

10. A low-pressure electric discharge lamp of the single-ended type that is adapted for use as a compact high-intensity light source, said lamp comprising:

a light-transmitting vitreous envelope of tubular configuration that has a substantially flat end wall and is terminated by a closure member which is hermetically sealed to said envelope, lead-in conductors extending through said closure member in paired relationship, an electrode connected to and supported by each pair of lead-in conductors and thereby providing a plurality of spaced electrode assemblies at the sealed end of the envelope, an ionizable medium within said envelope adapted to sustain an electric discharge when the electrodes are energized, an elongated partition assembly within said envelope extending from the substantially flat end wall thereof toward and beyond the electrodes at the sealed end of the envelope, said partition assembly comprising a plurality of panels that are seated against the envelope end wall and radially extend from a longitudinal axis to the arcuate walls of said envelope and thereby divide the envelope interior into a plurality of sectors which define a tortuous discharge channel that traverses the envelope in retroverted fashion, and means holding the partition assembly in said position within the envelope comprising a support member of rigid material that extends transversely across the envelope interior and is fastened to the end edges of the partition panels, the longitudinal and end edges of said partition panels that are seated against the arcuate side walls and substantially flat end wall, respectively, of said tubular envelope having laterally-extending flanges that are in contiguous overlapped relationship with the envelope walls and thus provide junctures which cannot be penetrated by the discharge and prevent the discharge from bypassing any of the partition panels, said lead-in conductors extending through said partition-support member and being so arranged that adjacent electrodes are physically isolated from one another by one of the partition panels which completely spans the space between the partition-support member and the substantially flat end wall of the envelope.

* * * * *